446-313 SR
10/15/85 XR 4,547,170

United States Patent [19]

Gurtner et al.

[11] Patent Number: 4,547,170

[45] Date of Patent: Oct. 15, 1985

[54] MOVEABLE TOY

[75] Inventors: Michael V. Gurtner, Manhattan Beach; Herbert May, Torrance, both of Calif.

[73] Assignee: Mattel, Inc., Hawthorne, Calif.

[21] Appl. No.: 569,630

[22] Filed: Jan. 10, 1984

[51] Int. Cl.[4] ..... A63H 11/00

[52] U.S. Cl. ..... 446/353; 446/313; 180/8.6

[58] Field of Search ..... 446/433, 444, 445, 447, 446/446, 330, 332, 352, 353, 355, 356, 313, 268, 324, 357, 278; 180/8.1, 8.5, 8.6, 8.7

[56] References Cited

U.S. PATENT DOCUMENTS

| | | | |
|---|---|---|---|
| 2,535,396 | 12/1950 | Dube | 446/445 X |
| 3,477,172 | 11/1969 | Polewski | 46/243 |
| 3,540,153 | 11/1970 | Aoki | 446/446 |
| 3,688,436 | 9/1972 | Wakimura | 446/447 X |
| 4,068,402 | 1/1978 | Tanaka | 46/216 |
| 4,221,076 | 9/1980 | Ozawa | 46/216 |
| 4,333,259 | 6/1982 | Lin | 446/353 X |

*Primary Examiner*—Mickey Yu
*Attorney, Agent, or Firm*—Ronald M. Goldman; Melvin A. Klein

[57] ABSTRACT

A moveable toy (10) consisting of a base (12) and a motorized vehicle (14). The base includes a track (46) having a central groove (50) ending in openings (54) at either end. The track includes teeth (48) which cooperate with a drive gear (44) held in the vehicle to drive the vehicle along the track. Rotors (56) having notches (58) on the top surface are rotatably held in openings at each end of the central groove in the track. Upon actuation, the vehicle travels along the track until it arrives at either end of the track, where the vehicle rotates the base to allow the vehicle to continue along the track end for further movement of the toy in the same direction.

34 Claims, 11 Drawing Figures

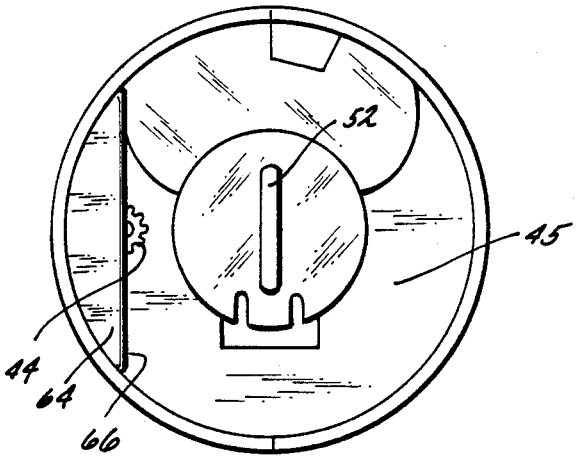
Fig. 6
Fig. 10
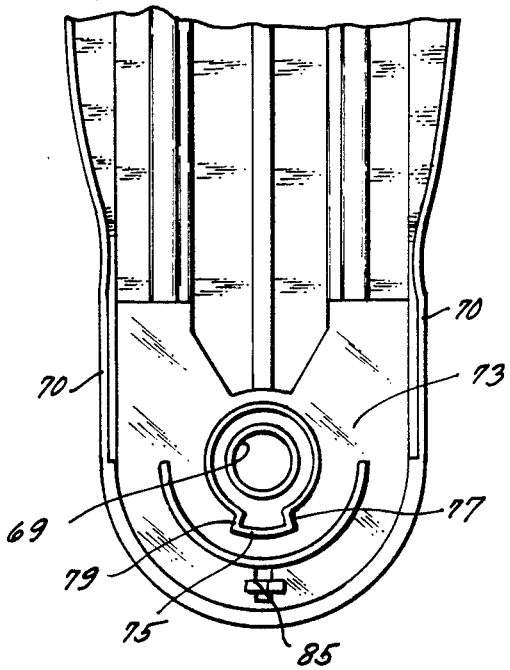

87
72
8
60
62
46
44
56
24
25
58
27
8
70
12
89
70
62
62
60
74
89
62

87
12
24
12
84'
58
87
56
84
54
24
50
46
12
12
24
62
62
87
89
54
56
60
58
62
60
62

MOVEABLE TOY

DESCRIPTION

1. Technical Field

This invention relates to toys and more particularly to a motorized moveable toy.

2. Background Art

Although no pertinent relevant prior art is known to applicant, toy devices are known which move back and forth along a track. U.S. Pat. No. 3,477,172 discloses a device in which a track also travels through the toy.

U.S. Pat. No. 4,068,402 discloses a vehicle running along a track in which a portion of the track is comprised of a carrier rotatably mounted between spaced apart end portions of the trackway. The vehicle moves into the carrier from one end portion, and by its momentum causes the carrier, with the vehicle, to be rotated to the other end portion. The vehicle then continues its movement along the trackway. In addition, a tower is positioned along the trackway. The tower has side portions provided with continuous racks engagable by rotating gears on the vehicle to propel the vehicle upwardly. The vehicle also includes other means to cause the vehicle to perform tricks, such as somersaults, as it moves upwardly on the tower.

Finally, U.S. Pat. No. 4,221,076 discloses a toy wheeled vehicle which moves along a trackway and performs various tricks. The vehicle may also be carried up and down a double inclined tower by means of gear portions extending out from the sides of the vehicle.

However, none of the prior art discloses a moveable toy of the type set forth in the present application wherein a vehicle moves along a track held on the toy, and wherein the track also moves relative to the vehicle, to allow both the toy and the vehicle to continue to move in a given direction.

DISCLOSURE OF THE INVENTION

In one aspect of the present invention there is provided a moveable toy having a base with two ends and a rotor means rotatably mounted at each end; a track having two ends is mounted to the base with each end of the track ending at a respective rotor means. A motor driven vehicle is removeably mounted on the track for travel along the track when the vehicle motor is actuated, whereby when the vehicle travels to either end of the track, the base on which the track is mounted will be caused to move by the vehicle to propel the moveable toy.

DESCRIPTION OF THE DRAWING

FIG. 6 is a bottom plan view of the base of the motor module of FIG. 4;

FIG. 10 is a partial bottom plan view of one end of the base with its foot removed, showing integral stop and holding means for the foot.

BEST MODE FOR CARRYING OUT THE INVENTION

A preferred embodiment of the moveable toy of the present invention is illustrated in the attached drawings wherein like numerals used throughout the several views indicate like parts.

Figures 1, 5:
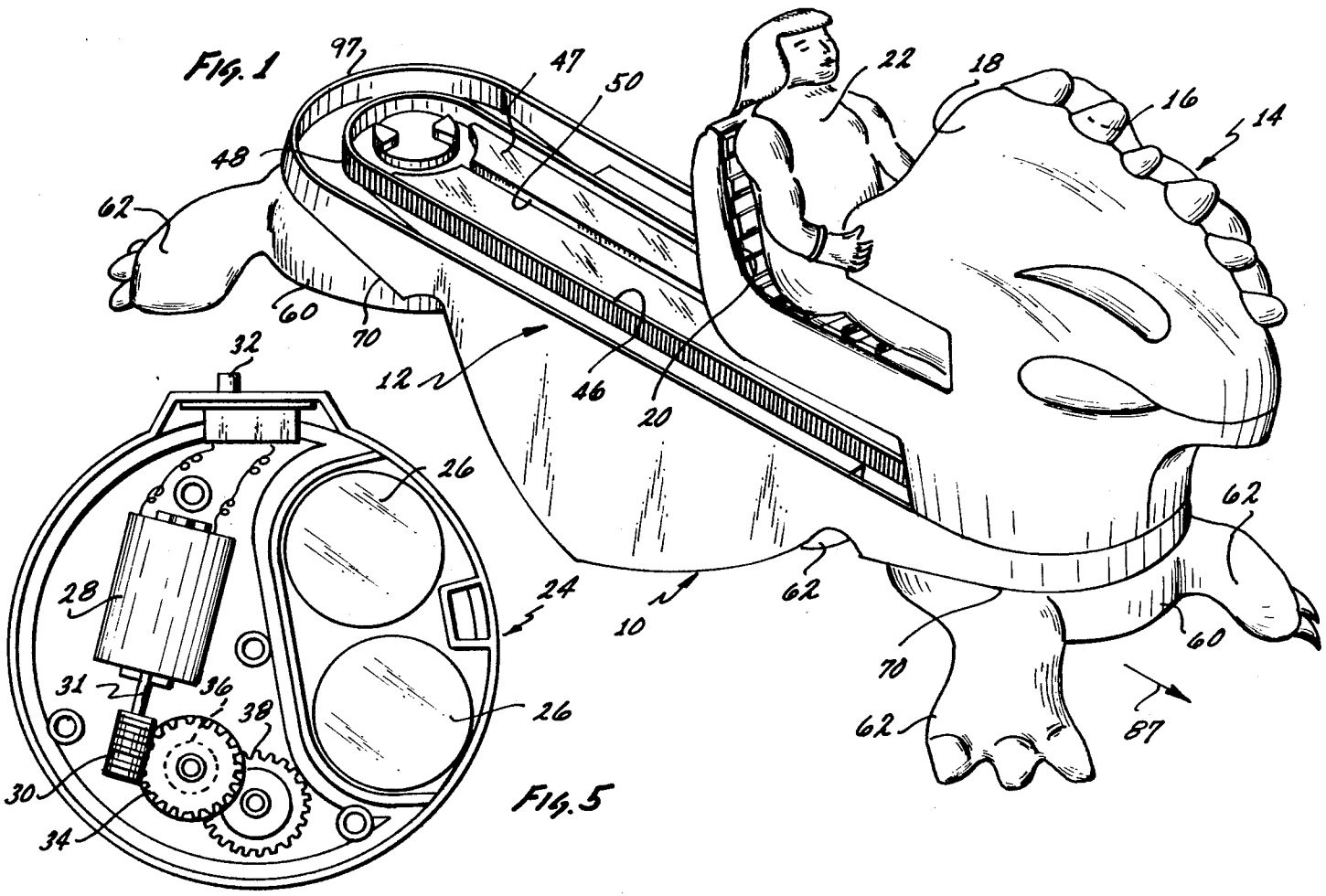
FIG. 1 is a perspective view of a preferred embodiment of a moveable toy of the present invention.
FIG. 5 is an enlarged cross-sectional view of a motor module of the present invention with batteries mounted therein.
Figure 2:
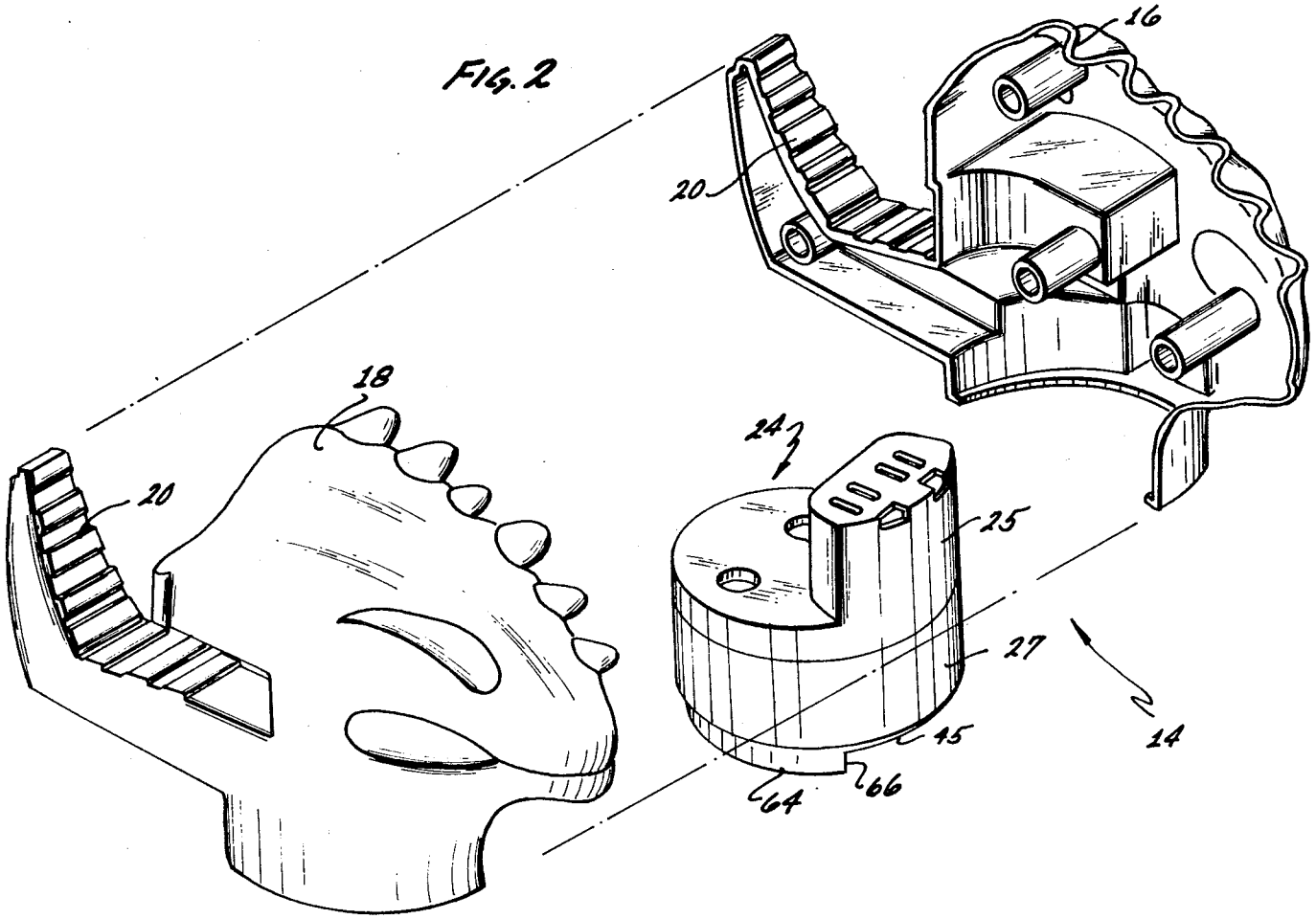
FIG. 2 is an exploded perspective view of the vehicle to be mounted on the track of the moveable toy of the present invention.
Figure 3:
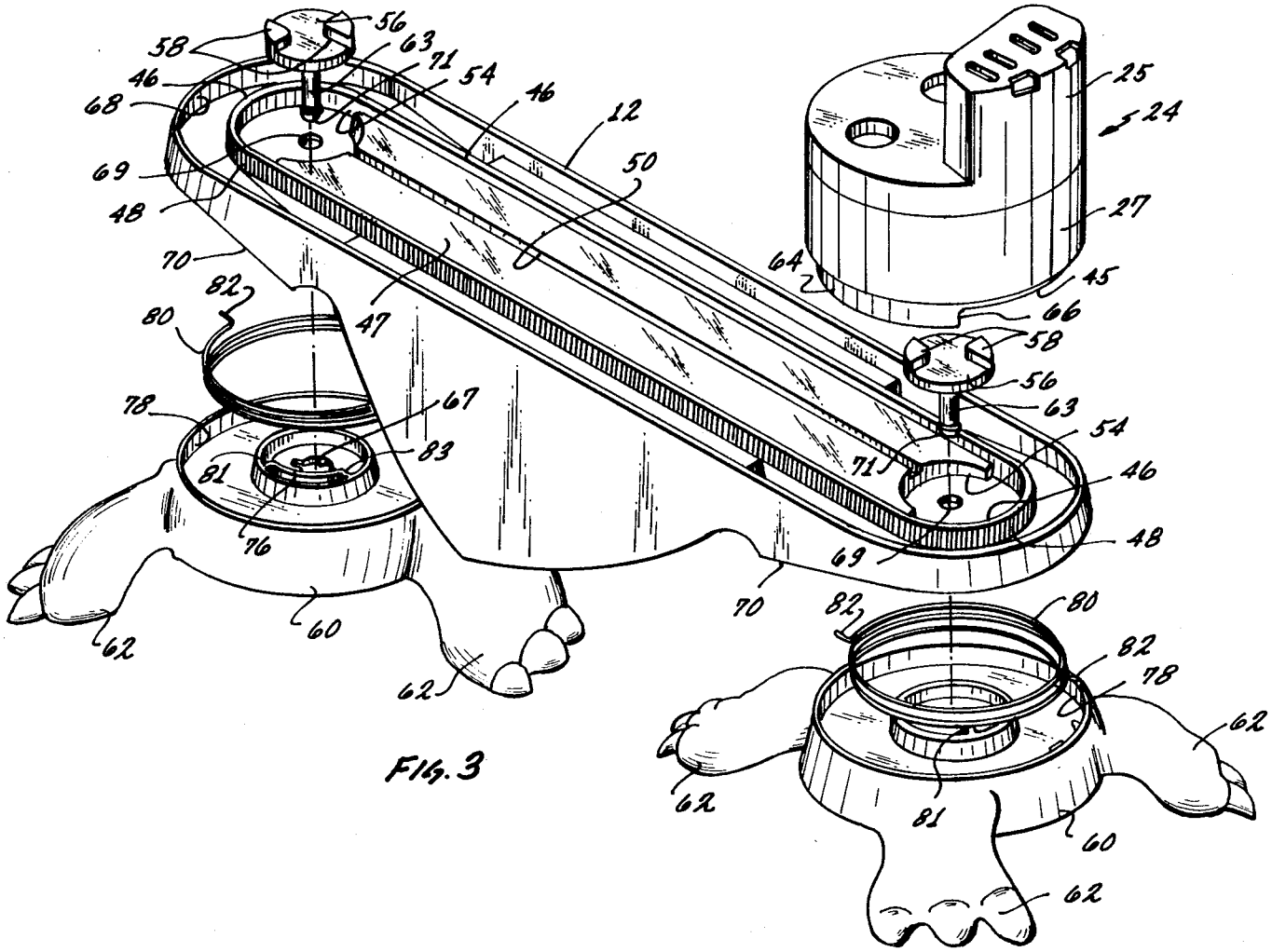
FIG. 3 is a partial exploded perspective view of the moveable toy of FIG. 1.
Figure 4:
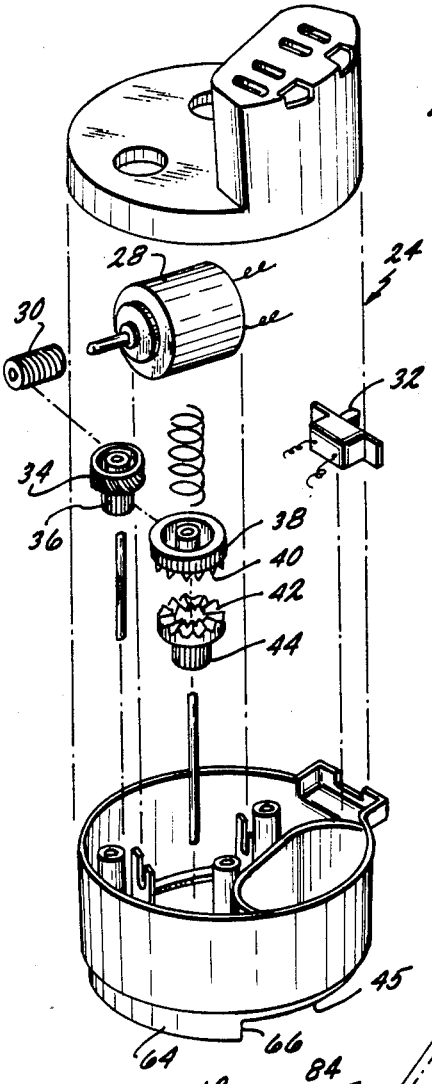
FIG. 4 is an exploded perspective view of the preferred embodiment of the motor module of the present invention.
Figure 8:
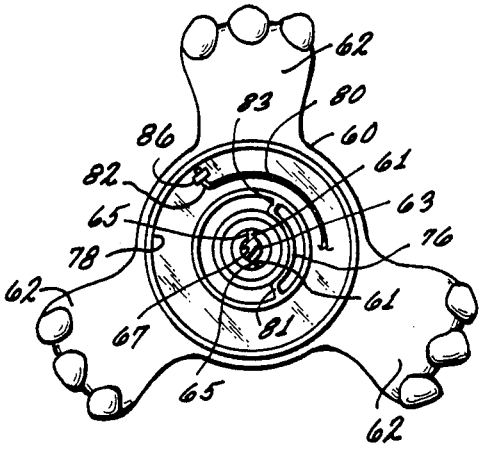
FIG. 8 is a cross-sectional view taken along line 8—8 of FIG. 7 showing a top plan view of one of the feet.

With reference to FIG. 1, there illustrated is a moveable toy 10 comprised of a base assembly 12 and a vehicle assembly 14. The vehicle may take any desired shape, such as the head of a dragon, and includes two halves 16, 18, forming a seat 20 therebetween to enable a toy figure or the like 22 to be placed in the seat and simulate the operation of the vehicle on the base, as by means of a control panel, handles and other means added to or formed on the vehicle adjacent the seat and the toy figure.

Figure 9:
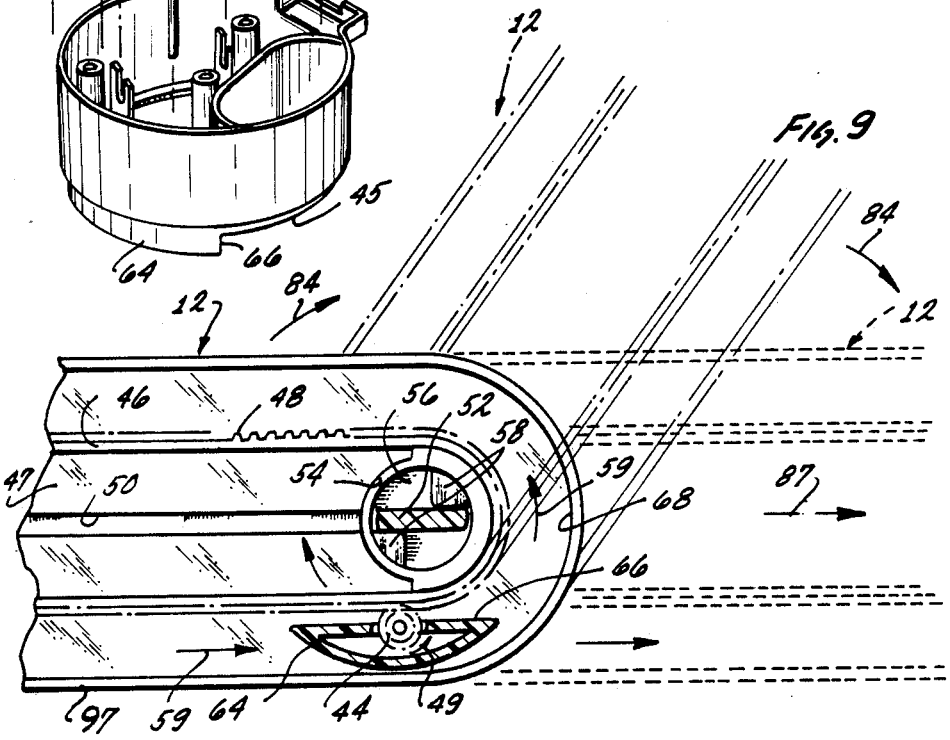
FIG. 9 is a partial top plan view of one end of the base, showing the base as it moves to various positions as the base is rotated, and the toy is propelled forward.

A motor module 24 is held within the vehicle 14, in any convenient manner, between the two halves 16, 18. As shown more clearly in FIGS. 2–6, the motor module is comprised of an upper portion 25, and a lower portion 27, and is substantially circular in shape. The interior of the module includes powered motor means, such as an electrical power source which may have one or more batteries 26, connected to an electrical motor 28. The motor drives a gear train through a worm gear 30 carried by the motor shaft 31, upon actuation of a switch means 32. The gear train is composed of gears 34, 36, 38, and 44 mounted on verticle shafts held in the module. Clutch means 40, 42 are disposed between gears 38 and 44 and operate in a well known manner. As shown in FIG. 6, the final drive or spur gear 44 extends outwardly from the base 45 of the motor module. And, as shown in FIG. 9, drive gear 44 meshes with a track 46 on base 15, to drive the vehicle 14, along the track, as explained more fully below.

The track 46, is supported on or formed integrally with the top surface 47 of base 12 and has a plurality of teeth 48 formed on the outer surface thereof, preferably extending in the vertical direction, perpendicular to surface 47. The vehicle 14 is driven along the track, within a groove 50. The teeth 48 essentially form an endless rack around the track, with groove 50 extending centrally of the track. A projecting member or blade 52 (See FIGS. 6 and 9) is formed on the base 45 of the motor module and is captured in the groove 50, to guide the travel of the vehicle along the groove.

The track has an open, substantially round portion 54, formed at each end thereof. The endless track or rack together with teeth 48 extends entirely around each of these openings, forming rounded track ends. Rotatably captured, for limited movement within the openings 54, are a pair of retaining members or rotor means 56, each of which has a pair of upwardly extending notches 58 formed thereon. The notches 58 are positioned so as to capture the blade 52 of base 45 therebetween when the blade leaves groove 50 (See FIG. 9). That is, as the vehicle leaves the groove and enters one of the openings 54, blade 52 will enter and be captured or held between opposed vertical surfaces formed on the notches and the vehicle will stop its forward movement. However, since the drive gear 44 continues to rotate in the direction of arrow 49 (FIG. 9), and the teeth 48 of the track 46 are meshed with gear 44, the track and supporting base 12 will be rotated around a foot or support means 60 underlying the rotor means 56 at that end of the base, as explained more fully hereinafter.

The supporting means 60, located at both ends of the base 12 may take any desired shape. However, in the preferred embodiment shown, are in the shape of dragon type feet having three, evenly spaced, extending toe portions 62. The rotors 56 are coupled to the supporting means or feet 60 for rotation therewith, as by a key and slot arrangement, with keys 61 fixed to shafts 63 of rotors 56, and slots 65 formed adjacent to central openings 67 extending through each foot. The shafts 63 of the rotors 56 extend through holes 69 formed centrally of the openings 54 at the ends of the track, and include enlarged end portions 71 which fixedly hold the rotors to the feet 60, but allow the feet to rotate with respect to the base 12.

As shown in FIG. 10, the lower surface 73 of the base, at either end thereof, is provided with a stop means 75 adjacent the opening 69. The ends 77, 79 of this stop means, coact with ends 81, 83 of a corresponding stop means 76 formed in each of the feet 60, to limit rotational movement of the rotors and feet, as described below.

OPERATION

The operation of the device will now be more fully explained. The vehicle 14, with motor module 24, and any covering or housing materials, such as 16, 18, forming the dragon, is placed on the track 46 with the blade 52 in the groove 50. The drive gear 44 engages or meshes with the teeth 48 along the outside of the track. As shown more clearly in FIGS. 6 and 9, the base or bottom 45 of the motor module 24 also includes a rounded outside guiding member 64 having a substantially straight internal wall 66. This guiding member 64 is captured within a guiding slot 68 formed between an outside wall 97 extending around the base 12 and the teeth 48 on the track 46. The guide 64 and straight wall 66, as well as the groove 50, prevent the entire vehicle 14 from being rotated with respect to the base, and allow the vehicle to be smoothly guided along the track, in the direction of arrows 59 (FIG. 9), and the rounded ends of the track to be guided as the track and base to which it is fixed are being rotated about a foot 60 by the drive gear 44.

Figure 7:
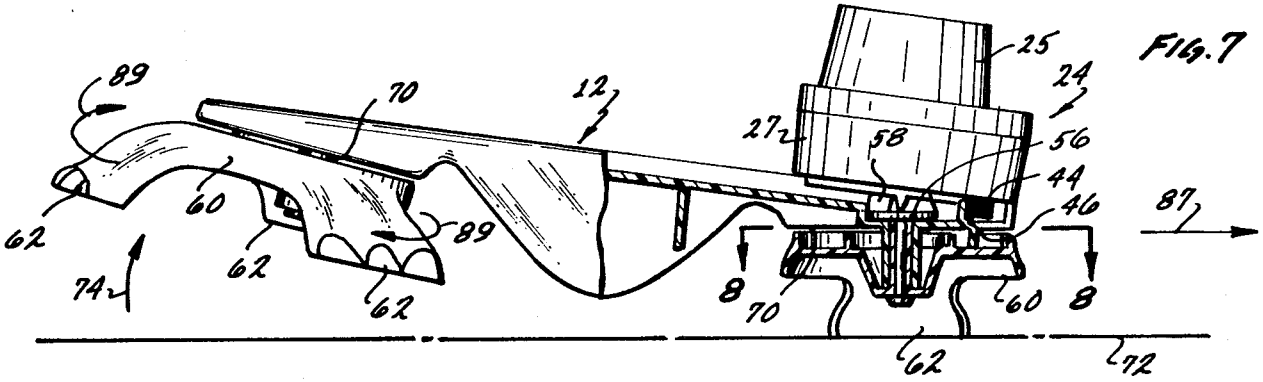
FIG. 7 is a side elevational view, partially in section, of the base with the motor module shown in position at one end of the base so as to lift the other end of the base above the surface on which the moveable toy rests.
Figure 11:
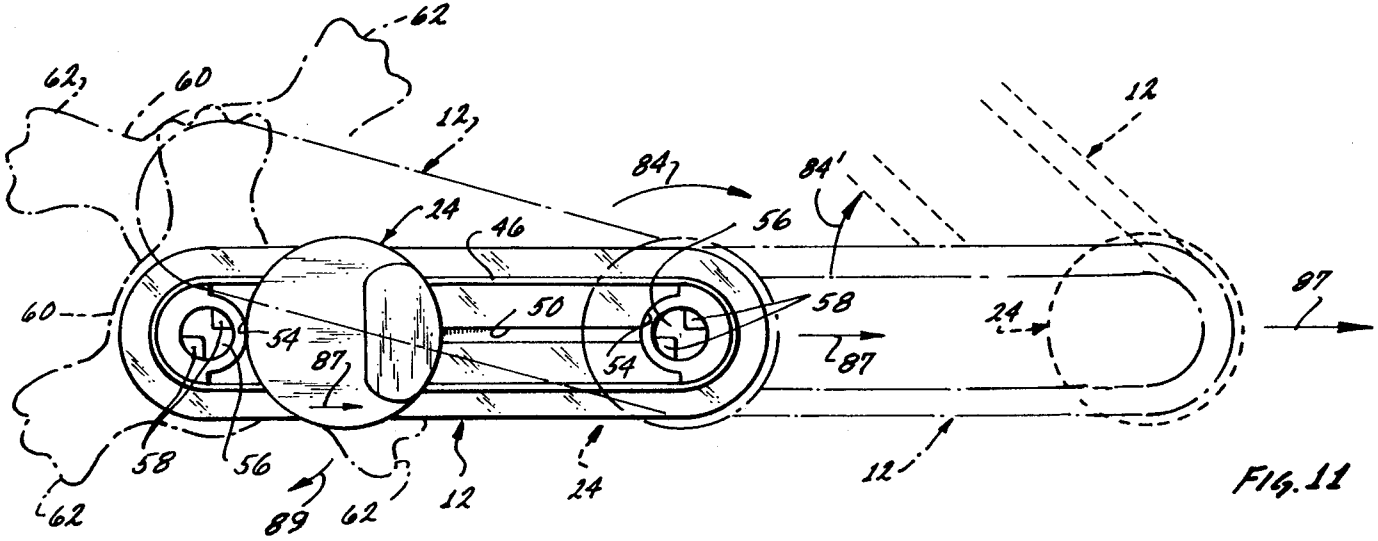
FIG. 11 is a top plan view of the moveable toy of the present invention with the motor module mounted on the track, and the module and the base in various positions, to simulate movement of the toy and the vehicle.

The entire base 12, including the track 46 is rotated substantially 180°, to the broken line position shown in FIGS. 9 and 11. The rotation of the base by the vehicle is explained more fully hereinafter, and is more easily accomplished due to slanted feet holding portions 70 formed on the lower surface 73 of the base 12. That is, at the opposite ends of the base, each foot 60 is attached to the lower surface 73 of the base at any desired angle, such as approximately 5°. In this manner, when the vehicle 14 is over, and is being guided around either rounded end of the track, the weight of the vehicle will cam the entire base of the toy about the inner toe 62 of the supporting foot 60. That is, the toe of the foot extending in the direction toward the other end of the base. Therefore, the end of the base on which the weight of the vehicle is pressing will move downward so as to rest on all three toes 62. This in turn causes the other end of the base to be lifted upwardly, from a floor or surface 72 on which it is travelling, in the direction of the arrow 74 (FIG. 7).

Each of the supporting means or feet 60 includes the stop mean 76 formed in an opening 78 on the top surface thereof. As described above, the ends 81, 83 of stop 76, cooperate with the ends 77, 79 of the stop means 75 formed on the lower surface of base 12, in different positions of the feet. A cylindrical return spring 80 is also contained in each foot 60, and cooperates with a holder 85 formed at each end in the lower surface 73 of the base 12, and in a similar holder 86 formed in each of the feet 60. That is, extending tabs 82 formed on the spring 80 are held in the holding means, 85, 86 and allow each of the feet to be rotated and then returned to its normal resting or starting position with the stop means in contact. The return to the starting position occurs after the base is rotated, the vehicle reaches the other end of the base, and the foot that has previously had the base rotated around it, lifted from the floor or surface. The forward direction of the toy and vehicle is shown by arrow 87 in FIGS. 1, 7, 9 and 11. The base 12 is rotated around a foot 60 in the clockwise direction, when looking at FIGS. 9 and 11 of the drawings. After the base is rotated, and the vehicle reaches the other end of the base, the foot 60 is lifted off the surface 72 (FIG. 7). The foot 60, off of the surface will be returned to its normal or starting position by its return spring 80 (see arrow 89, FIGS. 7 and 11).

After the full rotation of the base, and the inner toe 62 of each foot 60 is again resting on the surface 72, pointing toward the other end of the base, the vehicle will continue to travel along the groove 50. When the vehicle arrives at the other end of the track, the vehicle will stop its forward motion, the base will tilt, and the base will again be rotated forward, in front of the vehicle, to allow the vehicle to continue its forward motion.

In summary, the invention herein disclosed comprises two basic pieces, namely, a vehicle 14 and a base 12. The base 12 has its feet or supports 60 placed on a floor or surface, and the vehicle 14 is placed on the base, in a track 46 formed on or secured to the top surface of the base. The vehicle motor is started, as by actuation of the switch 32 so that the drive gear 44 drives the vehicle about the teeth 48 formed on the rack or track 46, guided in the grooves 50 and 68. The forward movement of the toy 10 and vehicle 14 is shown by the arrow 87. The vehicle moves along the track until it reaches one of the openings 54 formed at either end. The vehicle then moves into the opening with the lower blade 52 leaving the groove 50 and entering the aligned space defined by the notches 58 formed in opposite positions on the rotors 56. The forward motion of the vehicle is then stopped, but the drive gear 44 continues to rotate. Therefore, the cooperation of the rotating drive gear 44 with the teeth 48 of the track 46 causes the rounded end of the track as well as the entire base to be rotated about the underlying foot. The supporting means or foot 60 over which the base is being turned is in the start position, with the respective stop means 75, 76 having one of their respective ends abutting against each other.

Therefore this foot will not turn. However, since the rotor 56 has the blade 52 of the vehicle captured therein, the entire base is caused to rotate against the action of the spring 80, until the other ends of the stop means abut each other, approximately 180° from the start position. At the same time, the weight of the vehicle over the respective foot 60, causes the foot to pivot down from a single toe 62, onto all three toes. This pivoting of the foot raises the other end of the base upwardly, thereby picking up the other foot 60, at the opposite end of the base, from the surface 72 on which the moveable toy is travelling. The raised foot is rotated back to its normal or starting position with respect to the base 12, by the action of the return spring 80 unwinding (arrow 89). This pivoting of the base from the supporting surface also allows the entire base 12, to be more easily rotated about the foot on which it is pressed, in the direction of the arrows 84 (FIGS. 9 and 11). The rotation of the base 12, about the respective foot 60 continues until the ends of stop means 75, 76, make contact, that is, approximately 180°. The base and track will then be pointing in substantially the same direction the toy and vehicle had been pointing or travelling before. However, the base with the track thereon will now be stretched out ahead of the vehicle, that is, approximately 180° from its former position.

The vehicle then continues its travel along the track, with base 52 guided in the groove 50, and the guiding member 64 guided in slot 68, as described previously, until the vehicle reaches the opening 54 at the other end of the track. The vehicle enters the other opening 54, stops its forward motion, and causes the base to be rotated about the foot 60, in the same manner as described above. That is, the base 12 will be rotated in the direction of the arrow 84', (FIG. 11), by the drive gear 44 moving the rounded end of the track or endless rack. This movement of the base enables both the toy and the vehicle to keep moving forward, in the direction of arrow 87. That is, the toy will keep moving because the base is moved, and the vehicle will continue to move along the track on the base until it reaches one of the openings at the ends of the track on the base. Each time the vehicle reaches an end of the track on the base the base is rotated forward around the respective foot, again moving the toy. The toy and the vehicle will continue their forward motion until stopped, the batteries within the motor module lose power, or until the motor module is lifted off the track.

The particular form of the invention described herein and illustrated in the accompanying drawings is a preferred embodiment, and various changes in the size, shape, materials and arrangement of parts may be made without departing from the spirit of the invention or the scope of the attached claims.

We claim:

1. A moveable toy comprising:

a base having two ends with a rotor means rotatably mounted at each end;

a track having two ends mounted to the base with each end adjacent a rotor means; and a motor driven vehicle removeably mounted on the track for travel along the track when the vehicle motor is actuated, whereby when the vehicle reaches either end of the track, the base on which the track is mounted will be caused to move by the vehicle to thereby allow the moveable toy and the vehicle to continue to move in the direction the vehicle had been moving.

2. The moveable toy of claim 1 wherein each of the rotor means are provided with stop means to limit rotation thereof.

3. The moveable toy of claim 2 wherein the track is provided with teeth, and the vehicle includes a drive gear driven by the motor with the vehicle moveable about the track by engagement of the drive gear with the teeth.

4. The moveable toy of claim 3 wherein the drive gear both moves the vehicle around the track and rotates the base with the track thereon with respect to the vehicle.

5. The moveable toy of claim 4 wherein the vehicle includes a bottom portion having a blade extending downwardly therefrom, the blade cooperating with a guide groove having two ends extending along the base between the rotor means.

6. The moveable toy of claim 5 wherein the rotor means are rotatably mounted on the base at either end of the groove, adjacent the ends of the track; and the base is supported at each end by rotatable support means; and further including projecting means on the rotor means; the projecting means adapted to capture the bottom blade of the vehicle therebetween when the vehicle passes from one end of the groove on to the rotor means.

7. The moveable toy of claim 6 wherein a vehicle captured in the rotor means at one end of the base above the respective supporting means will rotate the base and the track with respect to the respective support means below the vehicle, to allow the vehicle to continue its travel in substantially the same direction along the track toward the other end of the base.

8. The moveable toy of claim 7 wherein the vehicle rotates the entire base approximately 180° from its starting position so as to point the base and track in the direction of travel of the vehicle and the moveable toy.

9. The moveable toy of claim 8 wherein the motor means is mounted internally of the vehicle, and operates a gear train connected to the drive gear, whereby, when the drive gear is contacting the teeth on the track, and the motor means is actuated, the drive gear will move the vehicle along the track, and, at each end of the track, rotate the base and the track in the direction toward which the vehicle had been moving.

10. The moveable toy of claim 9 wherein the base includes a lower surface having slanted end portions formed therein with the supporting means rotatably held thereon, whereby, when the vehicle reaches either end of the track, the slanted end portions enable the weight of the vehicle over a support means on the end to pivot downwardly, while at the same time, the opposite end of the base is pivoted upwardly to thereby allow the track and base upon which it rests, to be more easily rotated about the support means, approximately 180°.

11. The moveable toy of claim 1 wherein the track is provided with teeth to form an endless rack, and the vehicle includes a drive gear driven by the motor, and the vehicle is moveable about the endless rack by engagement of the drive gear with the teeth.

12. The moveable toy of claim 11 wherein the motor is held internally of the vehicle, and cooperates with the drive gear to both drive the vehicle around the endless rack and move the base with the track thereon with respect to the vehicle.

13. The moveable toy of claim 12 wherein the vehicle includes a bottom portion having a blade extending downwardly therefrom; the blade cooperates with a guide groove having two ends extending along the base between the rotor means centrally of the track.

14. The moveable toy of claim 13 wherein the rotor means are mounted on the base adjacent the ends of the groove; and the base is supported at each end by rotatable support means and further including projecting means on the rotor means; the projecting means adapted to capture the bottom blade of the vehicle therebetween when the vehicle passes from one end of the groove onto the rotor means.

15. The moveable toy of claim 14 wherein a vehicle captured in the rotor means at one end of the base above the respective supporting means will be driven around the end of the track by the gear means, and at the same time will rotate the base and the track with respect to the respective support means below the vehicle, to enable the vehicle to continue its travel in substantially the same direction along the guide groove, and to further move the toy once the vehicle travels along the track and reaches the other end thereof.

16. The moveable toy of claim 15 wherein as the vehicle is rounding one end of the track, it will rotate the entire base with the track thereon approximately 180° from its starting position so as to allow the vehicle to continue its travel in substantially the same direction of travel of the vehicle and the moveable toy.

17. The moveable toy of claim 16 wherein the motor means operates a gear train connected to the drive gear, whereby, when the drive gear contacts the teeth on the endless rack, and the motor means is actuated, the drive gear will move the vehicle about the endless rack, and at the ends of the track, rotate the base and the track in the direction which the vehicle, and moveable toy had been headed.

18. The moveable toy of claim 17 wherein the base includes slanted end portions formed on a lower surface with the support means rotatably mounted to the slanted end portions, whereby, when the vehicle reaches either end of the base, the slanted end portions enable the weight of the vehicle over the corresponding support means at that end to pivot that end downwardly, while the opposite end of the base is pivotably upwardly above the surface on which the toy is travelling to thereby allow the base to be rotated about the support means under the vehicle, approximately 180°.

19. A moveable toy in the shape of a dragon comprising a dragon shaped vehicle adapted to carry a play figure thereon supported in a base for travel along a track formed within the base; the base including support means at the ends thereof, and the track including a central groove for cooperation with a downwardly extending central blade portion formed in the base of the vehicle, the central groove and blade guiding the vehicle along the track; a plurality of vertically extending teeth around the exterior of the track to form an endless rack which engages a drive gear extending downwardly from the base of the vehicle; the track including rounded end portions having teeth on the exterior thereof whereby the vehicle may rotate the track by the drive gear; and openings formed adjacent the rounded end portions and rotor mean contained within the openings: each of the rotors having a pair of notches formed on the upper surface thereof, the notches adapted to capture the central blade of the vehicle therein after it leaves the central groove, whereby the vehicle will rotate the rounded end of the track and the base on which the track is mounted about the support means in the form of a dragon's foot fixed below the end of the base; the base being rotated approximately 180° to allow the vehicle to return into the groove for further movement along the track toward the other end thereof, and for further movement of the toy by continued rotation of the base.

20. A moveable toy in the shape of a dragon comprising a dragon vehicle capable of carrying a play figure thereon inserted on and held in a base having two ends, for travel along a track formed with in the base; the track including a central groove having two ends for cooperation with a downwardly extending central blade portion formed in the base of the vehicle for guiding the vehicle in a straight line; and a plurality of teeth formed around the exterior of the track to form an endless rack about which a drive gear, operated by motor means held internally of the vehicle, is driven; the track including rounded end portions by which the track and base may be rotated with respect to the vehicle by the drive gear, and centrally located openings adjacent the round end portions at each end of the central groove; rotor means contained within the openings, and each of the rotor means having a pair of notches formed thereon to capture the blade of the vehicle therein when it leaves the central groove at either end thereof, whereby the vehicle is held by the rotor means and the entire base is rotated approximately 180° about support means, in the shape of a dragon's foot, at either end of the base, by the drive gear turning the rounded end of the endless track, to allow the toy to move, and allow the vehicle to return into the groove and back toward the other end of the track.

21. A moveable toy comprising:

a base having two ends;

a track having two ends mounted to the base with each end adjacent an end of the track; and a vehicle mounted on the track for travel along the track, whereby when the vehicle reaches either end of the track, the base on which the track is mounted will be caused to move by the vehicle to thereby allow the moveable toy and the vehicle to continue to move in the direction the vehicle had been moving.

22. The moveable toy of claim 21 wherein each end of the base includes a rotor means.

23. The moveable toy of claim 21 wherein the track is provided with teeth and the vehicle includes a motor and a drive gear driven by the motor with the vehicle moveable about the track by engagement of the drive gear with the teeth.

24. The moveable toy of claim 23 wherein the drive gear both moves the vehicle around the track and rotates the base with the track thereon with respect to the vehicle.

25. The moveable toy of claim 21 wherein the vehicle includes a bottom portion having a blade extending downwardly therefrom, the blade cooperating with a guide groove having two ends extending along the base between the ends thereof.

26. The moveable toy of claim 25 wherein each end of the base includes rotor means rotatably mounted thereon at either end of a groove, adjacent the ends of the track; the base is supported at each end by rotatable support means; and further including projecting means on the rotor means; the projecting means adapted to capture a bottom blade fixed to the bottom of the vehicle therebetween when the vehicle passes from one end of the groove on to the rotor means.

27. The moveable toy of claim 26 wherein the vehicle captured in the rotor means at one end of the base above the respective supporting means will rotate the base and the track with respect to the respective support means below the vehicle, to allow the vehicle to continue its travel in substantially the same direction along the track toward the other end of the base.

28. The moveable toy of claim 21 wherein the vehicle is motorized and travels along the track until it rotates the entire base approximately 180° from its starting position so as to point the base and track in the direction of travel of the vehicle and the moveable toy.

29. The moveable toy of claim 21 wherein the vehicle includes motor means mounted internally thereof, said motor means operating a gear train connected to a final drive gear, and said final drive gear contacting teeth provided on the track, whereby when the motor means is actuated, the drive gear will move the vehicle along the track, and, at each end of the track, rotate the base and the track in the direction toward which the vehicle had been moving.

30. The moveable toy of claim 21 wherein the base includes a lower surface having slanted end portions formed therein with supporting means rotatably held thereon, whereby, when the vehicle reaches either end of the track, the slanted end portions enable the weight of the vehicle over a support means on the end to pivot downwardly, while at the same time, the opposite end of the base is pivoted upwardly to thereby allow the track and base upon which it rests, to be more easily moved about the support means.

31. The moveable toy of claim 30 wherein the track is provided with teeth to form an endless track, and the vehicle includes a drive gear driven by a motor, and the vehicle is moveable about the endless rack by engagement of the drive gear with the teeth.

32. The moveable toy of claim 31 wherein the motor is held internally of the vehicle, and cooperates with the drive gear to both drive the vehicle around the endless rack and move the base with the track thereon with respect to the vehicle.

33. The moveable toy of claim 21 wherein the vehicle includes a bottom portion having a blade extending downwardly therefrom; the blade cooperates with a guide groove having two ends extending along the base between the ends thereof centrally of the track.

34. The moveable toy of claim 21 wherein each end of the base includes rotor means mounted on the base adjacent the ends of a guide groove; said base being supported at each end by rotatable support means, and further including projecting means on the rotor means; the projecting means adapted to capture a bottom blade extending from said vehicle therebetween when the vehicle passes from one end of the groove onto the rotor means.

* * * * *